United States Patent [19]

Freeman

[11] 4,320,611

[45] Mar. 23, 1982

[54] FIRE RETARDANT SEAL

[76] Inventor: Albert J. Freeman, 2051 43rd Ave., San Francisco, Calif. 94116

[21] Appl. No.: 118,351

[22] Filed: Feb. 4, 1980

[51] Int. Cl.[3] ..... E04B 1/62

[52] U.S. Cl. ..... 52/309.1; 52/396; 52/403; 428/304.4; 404/49

[58] Field of Search ..... 404/49, 47, 65; 49/475; 428/315, 310, 266, 447, 291; 52/309.1, 309.4, 396, 403

[56] References Cited

U.S. PATENT DOCUMENTS

| | | | |
|---|---|---|---|
| 2,071,299 | 2/1937 | Gammeter | 404/49 |
| 2,961,731 | 11/1960 | Buzzell et al. | 52/396 |
| 3,286,425 | 11/1966 | Brown | 52/396 |
| 3,394,640 | 7/1968 | Dreher | 52/395 |
| 3,923,411 | 12/1975 | Berghman | 52/396 |
| 4,023,324 | 5/1977 | Majeske | 52/396 |
| 4,141,189 | 2/1979 | Borjeson | 52/396 |
| 4,174,244 | 11/1979 | Thomas et al. | 428/310 |
| 4,189,457 | 2/1980 | Clement | 49/475 |

FOREIGN PATENT DOCUMENTS

| | | | |
|---|---|---|---|
| 678685 | 1/1964 | Canada | 52/396 |
| 2061140 | 6/1971 | Fed. Rep. of Germany | 52/403 |
| 1283939 | 2/1962 | France | 52/396 |
| 1324615 | 3/1963 | France | 52/396 |
| 1434649 | 5/1976 | United Kingdom . | |

*Primary Examiner*—James L. Ridgill, Jr.
*Attorney, Agent, or Firm*—Townsend and Townsend

[57] ABSTRACT

A fire resistant seal for gaps between structural members is disclosed. A preformed elongate strip is provided of resilient silicone foam material and has a generally Y-shaped cross section. The width of the base of the Y is approximately equal to but no less than the width of the gap, and each of the legs of the Y have a width equal to one-half that of the base. The portion of the strip where the legs meet the base has a width in excess of that of the base alone.

9 Claims, 7 Drawing Figures

FIRE RETARDANT SEAL

BACKGROUND OF THE INVENTION

The present invention relates to seals placed between two structural members to provide resistance to fire propagation, and in particular to such seals using a preformed strip of fire resistant material.

In building construction, particularly concrete wall construction, gaps often exist between adjacent structural members. Such gaps can result from the use of prefabricated structural elements, or may be formed in place to allow for expansion of the structural elements. In either event, acceptable fire resistance requires that the gaps be sealed so that fire cannot readily propagate through the gaps between structural members.

The conventional technique for sealing gaps between structural members for fire resistance is to fill the gap with poured in place silicone foam material. Initially, a dam is formed in one end of the gap to provide an enclosed cavity. Next, silicone foam material is poured into the cavity, and allowed to set. Once the silicone foam is set, the dam is removed. This technique provides an acceptable seal unless poor workmanship is employed, which can result in voids in the sealing material which significantly degrade its resistance to fire propagation. This technique is relatively expensive in that it involves a large amount of hand labor.

Attempts have been made to provide a fire resistant seal by inserting a preformed strip of fire resistant material, as illustrated in British Pat. No. 1,434,649. However, the device proposed by the British patent is relatively complex, requiring refractory material adhering to a metallic spring, with silicone foam material embedded in the spring. Such devices are relatively impractical and are not commonly used.

The concept of inserting a preformed plastic strip into a gap between two structural materials for purposes other than fire resistance is not new. For example, such devices are shown in U.S. Pat. Nos. 3,286,425; 3,923,401; 4,023,324; and French Pat. No. 1,283,939. However, these devices leave air spaces within the seal, which is unacceptable for fire resistance. The only exception in U.S. Pat. No. 4,023,324, which requires that material be poured in place.

SUMMARY OF THE INVENTION

The present invention is a novel fire resistant seal for gaps between structural members. A preformed elongate strip is provided of resilient silicone foam material and has a generally Y-shaped cross section. The width of the base of the Y is approximately equal to but no less than the width of the gap, and each of the legs of the Y have a width equal to one-half that of the base. The portion of the strip where the legs meet the base has a width in excess of that of the base alone.

The device of the present invention completely fills the gap between the two structural members, leaving no air pockets which would degrade the strip's performance as a fire resistant seal. The legs of the Y-shaped cross section provide a pocket along one edge of the strip, and the strip can readily be inserted in the gap with a sharp tool pressed into the pocket. Because the portion of the strip where the legs meet the base of the Y has a cross section significantly in excess of that of the gap, this particular portion of the strip is compressed to much greater extent that the remainder, providing a linear seal within the gap.

In various preferred embodiments of the present invention, grooves are provided in the interior of one of the legs of the Y-shaped cross section and on the exterior of the base. The interior groove accommodates an adhesive so that the legs of the Y are sealed together upon insertion into a gap, minimizing the possibility that an air space will form between the legs of the strip after insertion in the gap. A material having combined adhesive and lubricating properties is placed in the exterior grooves to facilitate insertion of the strip and lock it in place once it has been fully inserted. Also, certain preferred embodiments include a fabric strip in the interior surface of the Y-shaped cross section so that the foam material is not damaged when it is pressed in place using a sharp tool.

The preformed strip of the present invention greatly facilitates the provision of a fire resistant seal in a gap between two structural members. Rather than the 2 or 3 individuals required to provide such a seal using conventional techniques, just one person can provide the seal in less time than before. There is no requirement for forms and the like, and detects inherent when extensive hand labor is used, which degrade the fire resistance provided, are avoided.

The novel features which are characteristic of the invention, as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
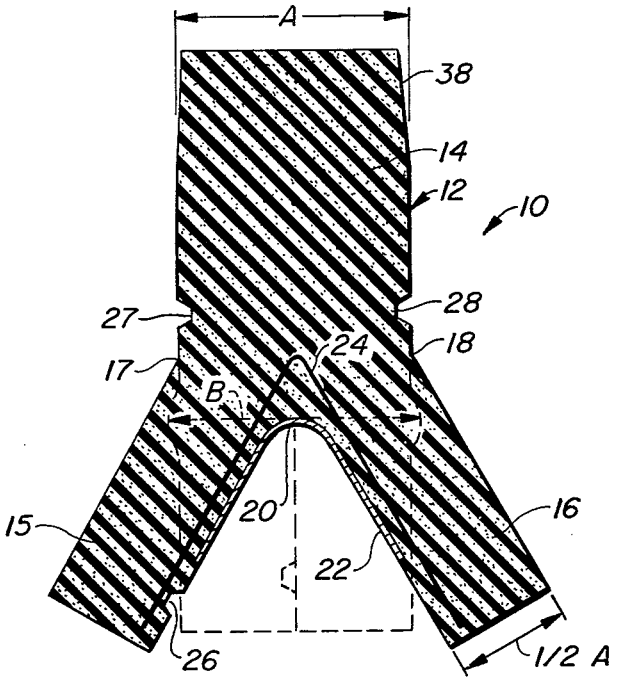
FIG. 1 is a sectional view of a preferred embodiment of the present invention.

A first preferred embodiment 10 of the present invention is illustrated generally by way of reference to FIG. 1. Embodiment 10 includes a strip 12 of fire resistant silicone foam material, such as that sold under the trademark RTV by Dow Corning. Strip 12 has a generally U-shaped cross section, including a base 14 and legs 15, 16. Base 14 has a generally constant width designated as "A" in FIG. 1. The widths of legs 15, 16 are equal to substantially one-half that of base 14, i.e., "½A".

On the exterior surfaces of strip 12, legs 15, 16 meet base 14 at sharp angles 17, 18. On the interior, however, legs 15, 16 meet base 14 in a smooth curve 20. As a result, strip 12 has an aggregate width (illustrated by the dashed lines) generally equal to A except where legs 15, 16 meet base 14, at which point the aggregate width is somewhat greater than A.

An insert 22 of silicon rubber glass cloth, such as that sold by Keene Corporation of Newark, Delaware, is embedded in the pocket formed by the interior surfaces of legs 15, 16. Glass cloth 22 is resistant to abrasion when a sharp tool is inserted in the pocket, as will be discussed in more detail hereinafter.

A metal spring 24 is embedded in strip 12. Metal spring 24 has a pair of ends which project into the respective legs 15, 16 of strip 12. A groove 26 is located on the interior surface of leg 15. In addition, grooves 27, 28 are located along the exterior surfaces of the strip.

Figure 2A:
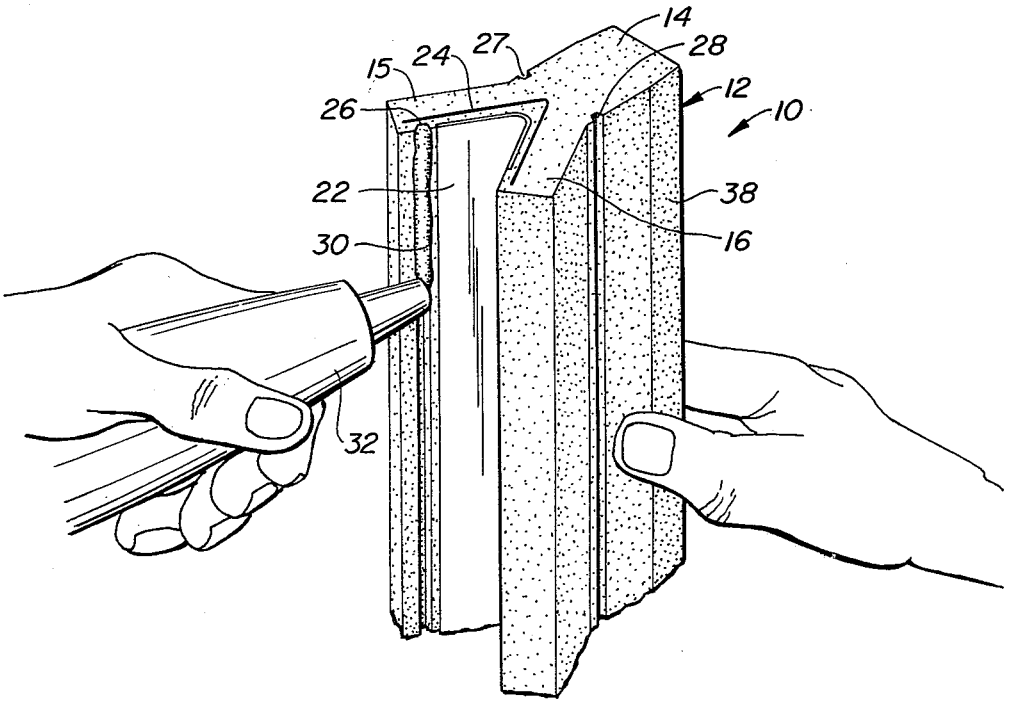
FIG. 2A–C are a sequence of views illustrating the installation of the embodiment of FIG. 1.
Figure 2B:
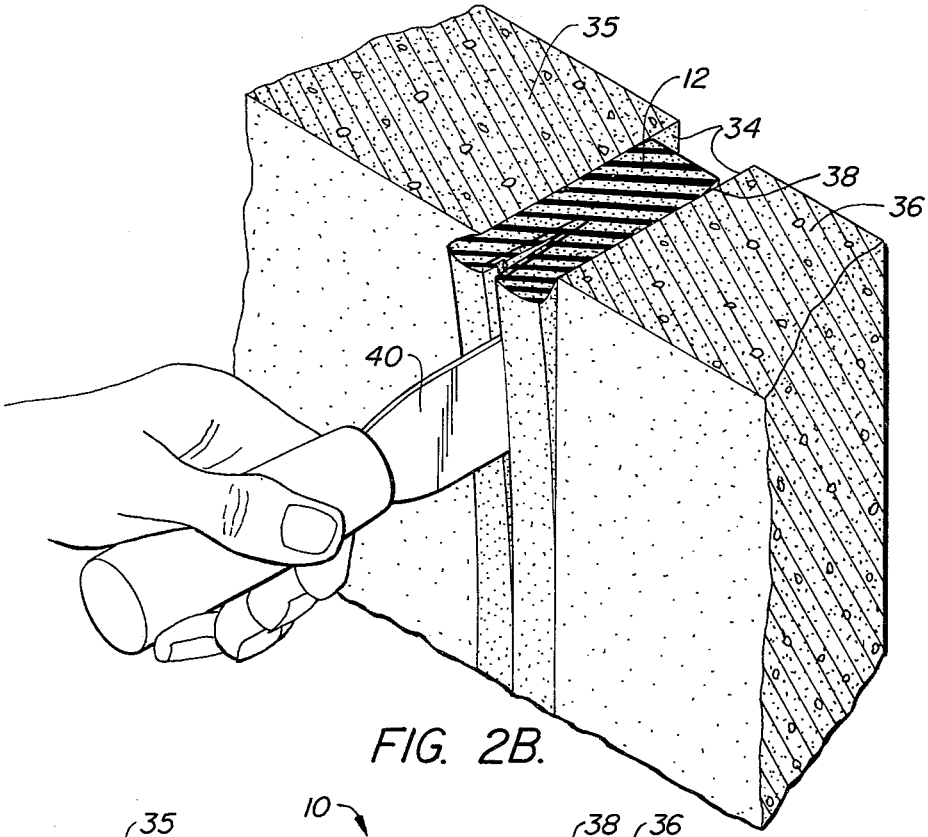
Figure 2C:
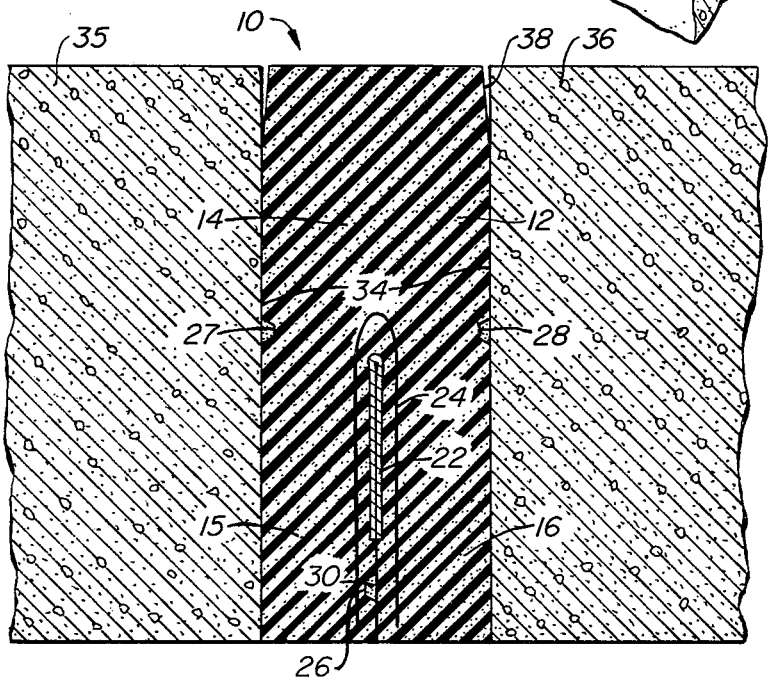

The manner in which embodiment 10 is inserted in a gap 34 between structural members 35, 36 is illustrated by way of reference to FIGS. 2A–C in sequence. Initially, as illustrated in FIG. 2A, an adhesive 30 is dispensed from a tube 32 into the groove 26 formed in the interior of leg 15. Thereafter, a material with both lubricating and adhesive properties is dispensed into exterior grooves 27, 28 in base 14 in the same fashion. Strip 12 is thus ready for insertion into the gap.

Referring now to FIG. 2B, strip 12 is pressed into gap 34 having transverse dimensions approximately equal to, but no greater than, those of the strip. To facilitate initial insertion, base 14 might be slightly tapered at 38 as illustrated. Complete insertion of strip 12 in gap 34 is achieved by forcing the strip into position using a putty knife 40 or other sharp instrument pressed into the pocket formed by legs 15, 16.

After complete insertion of strip 12 into gap 34, as illustrated in FIG. 2C, legs 15, 16 are pressed together, and secured to one another by adhesive 30 in groove 26. Since the width of strip 12 is, at most, only slightly larger than that of gap 34, most of strip 12 is under only slight compression. However, where legs 15, 16 meet base 14 of strip 12, the width of the strip is substantially greater than that of gap 34. As a result, in this region, strip 12 is under significant compression, and the strip is pressed against the interior surfaces of the gap. Accordingly, a linear seal is provided along the length of strip 12 between the strip and the surfaces of the gap.

Figure 3:
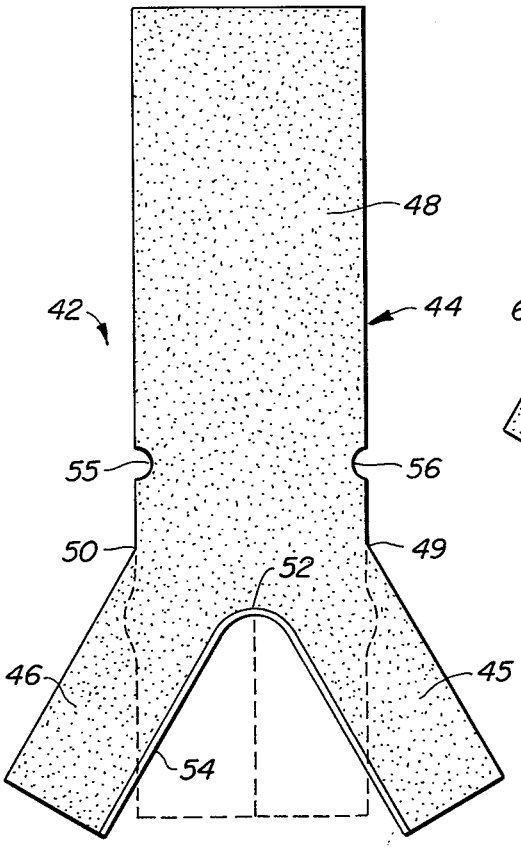
FIG. 3 is a sectional view of a second embodiment of the present invention.

A second embodiment 42 of the present invention is illustrated by way of reference to cross-section view of FIG. 3. Embodiment 42 constitutes an elongate strip 44 of silicone foam material of the same type used in the initial embodiment. Strip 44 has a generally Y-shaped cross section with legs 45, 46 meeting base 48 at the sharp angles 49, 50 on their outer surfaces. On their inner surfaces, legs 45, 46 meet base 44 in a smooth curve 52. As with the first embodiment, the aggregate cross section, illustrated by the dotted lines, is again equal to a constant dimension except where legs 45, 46 meet legs 48, where it has a slightly larger dimension.

An insert 54 of silicone rubber glass cloth is again provided to facilitate insertion of strip 44 to a gap with a sharp tool. Grooves 55, 56 are formed in the outer surface of base 48 to accommodate a lubricating and adhesive material placed in the grooves immediately before insertion of the strip.

Embodiment 44 differs from the first embodiment 10 in that insert 54 occupies the entire inner surface of legs 45, 46, and no interior groove is provided for an adhesive. Strip 44 has a substantially deeper cross section, and the fact that the legs are not glued together upon insertion is of less impact.

Figure 4:
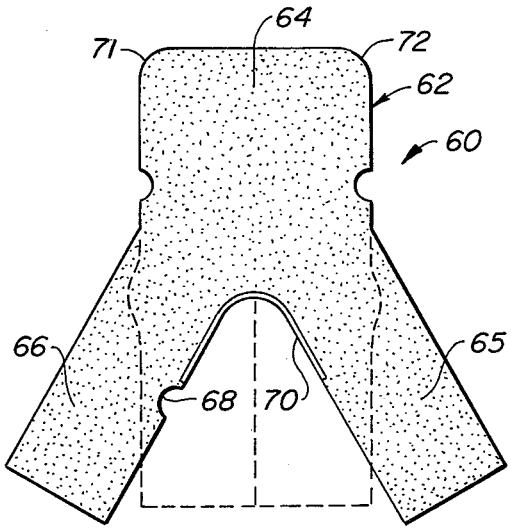
FIG. 4 is a sectional view of a third embodiment of the present invention.

A third embodiment 60 of the present invention is illustrated in cross section in FIG. 4. Embodiment 60 includes a Y-shaped strip of silicone foam material 62 having a base portion 64 and legs 65, 66. Embodiment 60 differs from the previous two embodiments in that the depth of strip 62 is relatively small. Accordingly, a groove 68 for an adhesive is provided between the legs 65, 66 and the size of insert 70 is reduced. Moreover, no tapes are provided in the base portion 64, but the edges 71, 72 are slightly rounded to facilitate insertion.

Figure 5:
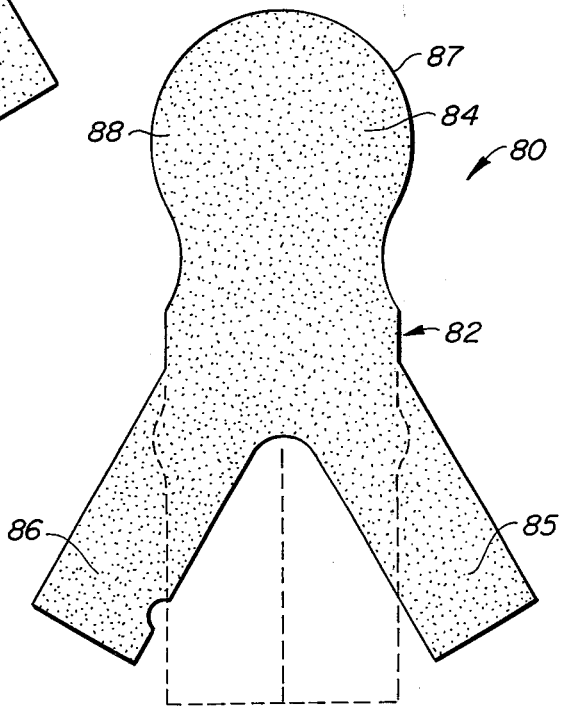
FIG. 5 is a sectional view of a fourth embodiment of the present invention.

A fourth embodiment of the present invention is illustrated in cross section in FIG. 5. Again, embodiment 80 includes a strip 82 of silicone rubber material. Strip 82 again has a Y-shaped cross section including base 84 and legs 85, 86. In embodiment 80, however, base 84 is rounded to provide bulges 87, 88 which are wider than the width of the gap to be filled. As a result, when strip 84 is inserted in the gap, bulges 87, 88 are compressed to increase surface contact between the sides of strip 82 and the surfaces of the gap to be filled.

Several preferred embodiments have been illustrated above. It is apparent that these embodiments share certain characteristics. Specifically, each of the embodiments has a generally Y-shaped cross section. The width of the material is generally constant except when the legs meet the base of the Y-shaped cross section, where the width is slightly larger. Each of the embodiments have certain additional features to achieve various objectives.

While several preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims:

What is claimed is:

1. A device for providing a fire resistant seal in a gap between two structural members, said device comprising a preformed elongate strip of resilient silicone foam material having a generally Y-shaped cross section, each of the legs of the Y-shaped cross section having a width equal to one-half that of the base, and the portion of the strip where the legs meet the base of the Y having a width in excess of that of the base alone so that upon insertion of the strip into the gap, the legs of the Y-shaped strip are pressed together, the strip assumes the rectangular cross-section of the gap, and the portion of the strip where the legs meet the base is compressed and thereby provides a tight seal between the strip and the surfaces of the gap wherein air pockets other than those inherent in the cellular structure of the foam material are absent throughout the length and breadth of the seal.

2. The device of claim 1 wherein the legs of the Y-shaped cross section meet the base at a sharp angle on the exterior surfaces of the strip and in a smooth curve on the interior surfaces of the strip.

3. The device of claim 1 wherein the strip includes an elongate axial groove formed in the interior surface of one of the legs of the Y-shaped cross section adapted to receive an adhesive to cement the two legs of the Y to one another upon insertion of the strip into the gap to inhibit the formation of an air pocket between the legs of the Y-shaped cross section.

4. The device of claim 1 wherein the elongate strip additionally includes a pair of elongate axial grooves on the outer surfaces of the base of the Y-shaped cross section adapted to receive a material having lubricating and adhesive properties to facilitate the insertion of the strip into the gap and cement the strip in place in the gap without introducing air pockets into the seal.

5. The device of claim 1 wherein the strip additionally includes a liner of silicone fabric located on the interior surface of the strip where the legs meet the base of the Y-shaped cross section so that the strip can be inserted into the gap using a sharp tool without damaging the silicone foam material.

6. The device of claim 1 wherein the strip includes a V-shaped stiffener embedded in the strip and extending into the legs of the Y-shaped cross section of the strip to bias the legs of the Y-shaped cross section against the surfaces of the gap.

7. The device of claim 1 wherein the base of the Y-shaped cross section of the strip is tapered slightly inwardly at the end opposite from the legs of the Y-shaped cross section to facilitate insertion of the strip in the gap.

8. The device of claim 1 wherein the base of the Y-shaped cross section of the strip includes a portion having a thickness slightly greater than the remainder of the base to provide a region of enhanced adherance with the surfaces of the gap.

9. A device for providing a fire resistant seal in a gap between two structural members, said device comprising a preformed elongate strip of resilient silicone foam material having a generally Y-shaped cross section, each of the legs of the Y-shaped cross section having a width equal to one-half that of the base, the legs of the Y-shaped cross section meeting the base at a sharp angle on the exterior surfaces of the strip and in a smooth curve on the interior surfaces of the stip so that the portion of the strip where the legs meet the base the base of the Y has a width in excess of that of the base alone, said strip including an elongate axial groove formed in the interior surface of one of the legs of the Y-shaped cross section adapted to receive an adhesive to cement the two legs of the Y to one another upon insertion of the strip into the gap, said strip additionally including elongate axial grooves on the outer surfaces of the base of the Y-shaped cross section adapted to receive a material having lubricating and adhesive properties to facilitate the insertion of the strip into the gap and cement the strip in place, and a liner of silicone fabric located on the interior surface of the strip where the legs meet the base of the Y-shaped cross section so that the strip can be inserted in the gap using a sharp tool without damaging the silicone material, the strip then assuming the rectangular cross-section of the gap, the portion of the strip where the legs meet the base being compressed and therefore providing a tight seal between the strip and the surfaces of the gap in addition to the lubricating and adhesive material wherein air pockets other than those inherent in the cellular structure of the foam material are absent throughout the length and breadth of the seal.

* * * * *